United States Patent [19]

Mayhew

[11] 4,055,250

[45] Oct. 25, 1977

[54] FOLDING BLANK, VEHICLE SIMULATING DISPLAY

[75] Inventor: Theron T. Mayhew, Emporia, Kans.

[73] Assignee: Hopkins Manufacturing Corporation, Emporia, Kans.

[21] Appl. No.: 707,306

[22] Filed: July 21, 1976

[51] Int. Cl.[2] ..... B65D 5/00

[52] U.S. Cl. ..... 206/457; 229/8; 229/16 D; 46/1 L; 206/44.11

[58] Field of Search ..... 206/457, 44.11; 229/16 D, 34 R, 8; 46/1 L, 11

[56] References Cited

U.S. PATENT DOCUMENTS

| | | | |
|---|---|---|---|
| 564,593 | 7/1896 | Craw | 229/34 R |
| 3,099,443 | 7/1963 | Koch | 46/11 |
| 3,259,295 | 7/1966 | Butz | 229/8 |
| 3,261,619 | 7/1966 | Norgaard, Jr. et al. | 229/8 |
| 3,419,133 | 12/1968 | Stone | 229/16 D |
| Re. 24,946 | 3/1961 | Burden | 229/34 R |

FOREIGN PATENT DOCUMENTS

| | | | |
|---|---|---|---|
| 904,806 | 7/1972 | Canada | 206/457 |
| 1,047,344 | 7/1953 | France | 46/11 |

*Primary Examiner*—William Price
*Assistant Examiner*—Douglas B. Farrow
*Attorney, Agent, or Firm*—Kenway & Jenney

[57] ABSTRACT

A one piece folding blank has front, side and rear panel groups that each fold towards a central floor panel to form a vehicle simulating display. A tab lock formed in the front panel engages an underlying portion of the side panels that is spaced from the floor panel to secure the front panel in the folded, vehicle simulating position. When folded, the panel groups form the walls of a box-like rear container portion of the display with at least the side and rear walls having a double wall construction. In one embodiment, the rear container portion is secured in the folded condition by locking tabs and tuck flaps formed on the periphery of the panel groups that engage, respectively, slots formed in the floor panel and spacings between the double wall panels.

17 Claims, 5 Drawing Figures

FOLDING BLANK, VEHICLE SIMULATING DISPLAY

BACKGROUND OF THE INVENTION

This invention relates in general to folding blank displays and more particularly to one piece folding blanks that fold and lock to form self-supporting vehicle simulating displays.

Display units, packaging containers, and the like formed from one or more pieces of a flexible, sheet material such as cardboard or plastics are well known in the art. More specifically, it is known to form relatively simple box-like cardboard containers for holding and displaying merchandise at retail sales outlets. While such structures are suitable for holding the articles on sale, they usually have a limited promotional and sales value. More complex displays are generally more effective merchandising aids, but they often require additional component pieces and are more difficult to assemble than the conventional box-like structures. Moreover, the conventional containers, and even more complex displays, usually do not suggest the nature or use of the product held in the display. These deficiencies are particularly acute in the sale of certain motor vehicle accessories such as stick-on thermometers and stick-on levels for use on camping vehicles where it is desirable to display the accessories in a structure which simulates such a vehicle and illustrates the use of the accessories.

It is therefore a principal object of this invention to provide a one piece blank that readily folds to form a vehicle simulating display and has a simple tab locking system that reliably secures the blank in the folded vehicle simulating position.

Another object of the invention is to provide a vehicle simulating display which provides a rugged, doublewalled container area which is highly durable and has good thermal insulating properties.

Still another object of this invention is to provide such a vehicle simulating folding blank display which has a relatively low cost of manufacture, is easy to assemble, and can be detachably secured within a surrounding sheet of material.

SUMMARY OF THE INVENTION

A one piece folding blank has a central floor panel of generally rectangular shape. Front and rear panel groups and a pair of side panel groups are foldably secured to the edges of the floor panel. Each of these panel groups is foldable towards the central panel to a vehicle simulating position. The side and rear panel groups each include inner and outer wall panels which fold over one another to form a double walled, generally box-like container area at the rear portion of the simulated vehicle. An inner wall panel of the front panel group provides the fourth wall of the container area. The front panel group is secured in a position which simulates the front end of a motor vehicle by at least one locking tab that engages a portion of the side panel groups spaced above the floor panel.

In a preferred form, locking tabs and tuck flaps formed on the periphery of the panel groups engage slots in the floor panel and openings between the inner and outer wall panels, respectively, to secure the folded blank in the vehicle simulating position. Also, portions cut from the floor panel simulate the wheels of the vehicle when the outer side wall panels are folded to the position perpendicular to the floor panel.

These and other features and objects of the invention will be more fully understood from the following detailed description of the preferred embodiments which should be read in light of the accompanying drawings.

DETAILED DESCRIPTION OF THE PREFERRED EMBODIMENTS

Figures 1, 2, 3:
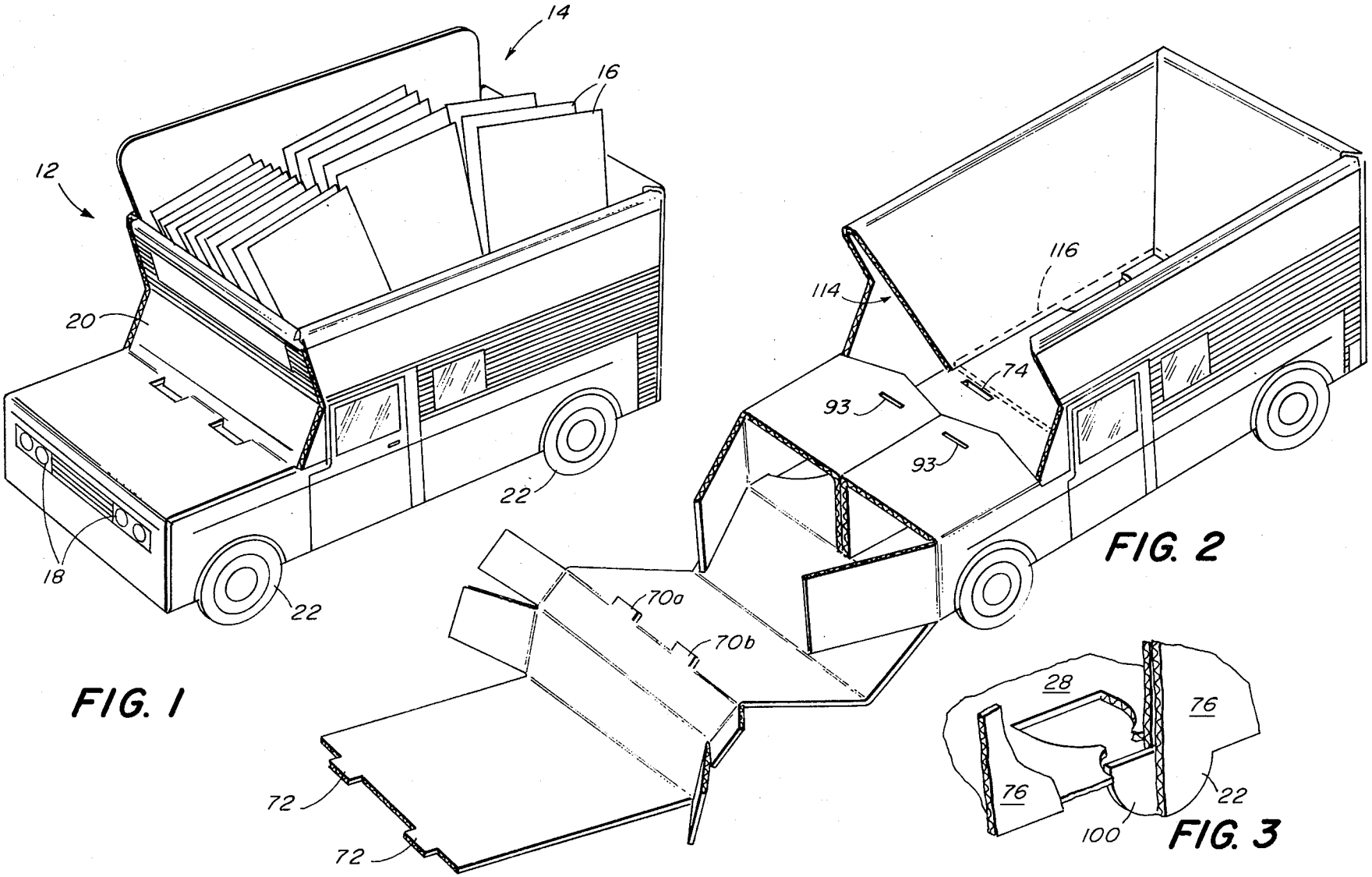
FIG. 1 is a view in perspective of a folding blank display constructed according to the invention which has been folded and locked to simulate a camping vehicle with a rear container area holding accessories for use on such vehicles.
FIG. 2 is a view corresponding to FIG. 1, with the accessories omitted, showing the front panel group of the display unfoled.
FIG. 3 is a detailed view in perspective of a simulated wheel of the vehicle.

FIG. 1 illustrates a folding blank constructed according to the invention which has been folded and locked into a position which simulates a camping vehicle 12. The vehicle 12 is shown in use as a point of purchase counter display for products held in a container area 14 formed at the rear portion of the vehicle. The vehicle 12 is particularly adapted to merchandising small accessories for such camping vehicles including stick-on thermometers and stick-on leveling devices packaged on cards 16. The outer surfaces of the folded blank are preferably printed to suggest portions of a camper such as a front grille and headlights 18, a windshield 20, and wheels 22.

Figure 4:
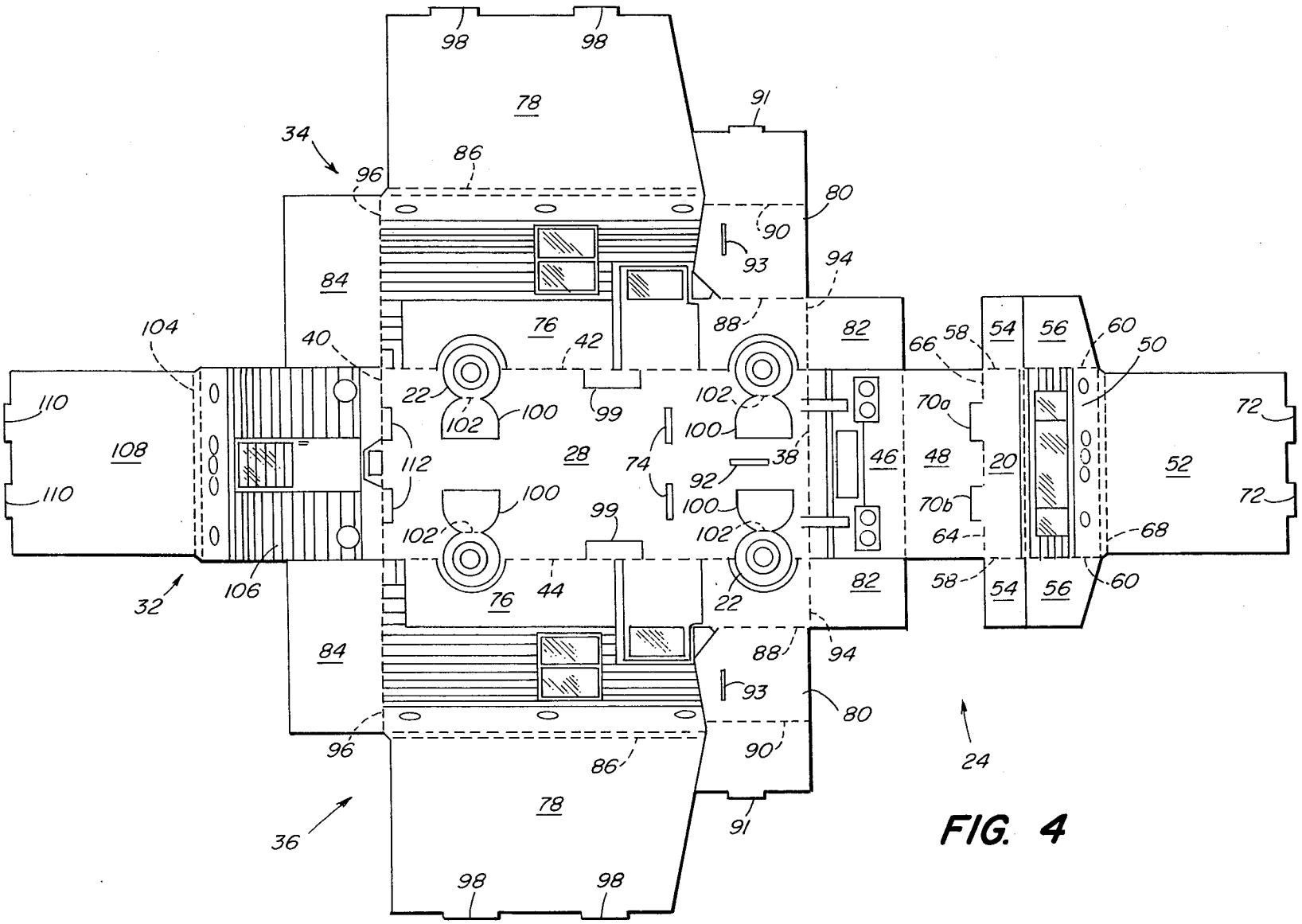
FIG. 4 is a top plan view of the folding blank in its unfolded condition.
Figure 5:
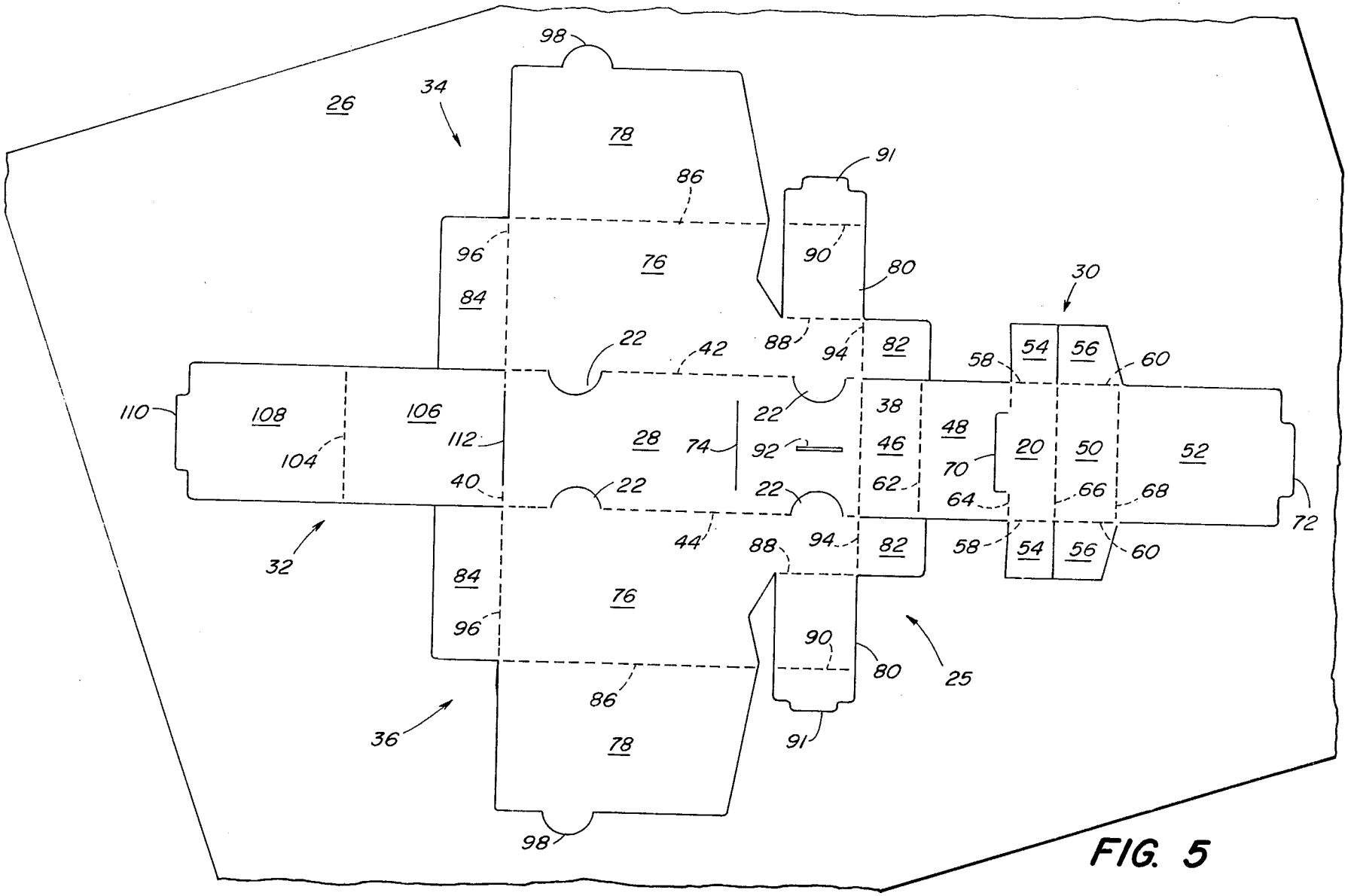
FIG. 5 is a top plan view of an alternative embodiment of the invention in its unfolded condition and detachably secured within a sheet of the material forming the folding blank.

FIG. 4 shows a folding blank 24 in a flat, unfolded condition which forms the vehicle 12 shown in FIGS. 1–3. FIG. 5 shows a similar, somewhat simplified, folding blank 25 also constructed according to this invention. (In the following description, the corresponding elements in these embodiments are identified by the same reference number unless otherwise noted.) The solid lines in FIGS. 4 and 5 indicate lines along which the folding blank is cut. The dotted lines indicate lines along which the blank is folded. Preferably the fold lines represent actual creases, perforations, or thinned regions which facilitate and guide the folds. In the embodiment shown in FIG. 5, the blank 25 is detachably secured within a sheet 26 of the material forming the blank itself. In this form, the folding blank is a convenient advertising and promotional device since advertising and promotional copy can be printed on the surrounding sheet 26 and the blank 25 can be removed and folded to form a small, toy-like version of the display. More generally, the folding blank of this invention leads itself for use as a toy or as a tray suitable for carrying food and beverages sold at a fast food outlet.

With reference to FIGS. 1–5, the folding blanks 24 or 25 are formed from a single, continuous piece of any suitable material which is flexible and capable of being folded. In the preferred embodiment shown in FIGS. 1–4, the folding blank is preferably formed from conventional corrugated cardboard. In the embodiment shown in FIG. 5, the blank is preferably formed from a sheet of plastic coated paper.

The folding blanks 24 and 25 include a central, generally rectangular floor panel 28, a front panel group 30, a rear panel group 32 and a pair of side panel groups 34 and 36, with these panel groups foldably secured to the floor panel along its edges at the fold lines 38, 40, 42 and 44, respectively. The following Table I lists the component parts of these panel groups and identifies the part of the vehicle simulated by these component parts, where applicable.

TABLE I

| Blank Group or Part | Reference No. |
|---|---|
| Vehicle Base Simulating Panel | 28 |
| Vehicle Wheel Simulating Portions | 22, 100 |
| Vehicle Container Area Floor Simulating Panel | 116 |
| Vehicle Front End Simulating Group | 30 |
| Vehicle Grille Simulating Panel | 46 |
| Vehicle Hood Simulating Panel | 48 |
| Vehicle Windshield Simulating Panel | 20 |
| Vehicle Outside Front Wall Simulating Panel | 50 |
| Vehicle Container Area Front Wall Simulating Panel | 52 |
| Tuck Flaps | 54, 56 |
| Vehicle Side Simulating Groups | 34, 36 |
| Vehicle Outer Side Wall Simulating Panels | 76 |
| Vehicle Container Area Side Wall Simulating Panels | 78 |
| Hood Support Panels | 80 |
| Front Flaps | 82 |
| Rear Tuck Flaps | 84 |
| Vehicle Rear Simulating Group | 32 |
| Vehicle Rear End Simulating Panel | 106 |
| Vehicle Container Area Rear Wall Simulating Panel | 108 |

The front panel group includes a grille panel 36, a hood panel 48, a windshield panel 20, an outer front wall panel 50 and an inner front wall panel 52. Tuck flaps 54, 54 and 56, 56 and foldably secured to the windshield and outer front wall panels 50 and 20, respectively, along the fold lines 58, 58 and 60, 60. The panels 46, 48 20, 50 and 52 extend forward of the floor panel 28 in the direction of its longitudinal axis with transverse fold lines 62, 64, 66 and 68 separating adjacent panels. The fold line 64 is interrupted by an "over-center" locking tab 70 formed in the hood panel 48. In FIG. 5, the tab 70 is shown as a single tab extending a substantial portion of the width of the hood panel 48. In FIGS. 1, 2 and 4 the tab 70 is formed as two separate tabs **70*a* and 70*b* spaced along the fold line 64. Locking tabs 72 formed on the front edge of the inner wall panel 52 are adapted to engage slots 74 formed in the floor panel 28**.

The side panels 34 and 36 are mirror images of one another, each having an outer wall panel 76, an inner wall panel 78, a hood support panel 80, a front flap 82 and a rear tuck flap 84. The inner and outer wall panels 76 and 78 are divided by a fold line 86 extending generally in a direction of the longitudinal axis of the floor panel. Fold lines 88 define the point of attachment of the hood support panels 80, 80 to the outer wall panels 76. Each hood support panel 80 includes a longitudinally extending fold line 90. A lock tab 92 formed at the lateral edge of each hood support panel 80 is adapted to engage a longitudinally extending slot 92 formed in the floor panel. The hood support panels shown in FIGS. 1, 2 and 4 also carry slots 93, 93 adapted to receive the tabs **70*a* and 70*b*. The front flaps 82, 82 and the rear tuck flaps 84, 84 are secured to the front and rear edges of the outer wall panels 76 along the transversely extending fold lines 94 and 96**, respectively.

The wheels 22 are formed in the floor panels 28 by hemi-circular cuts located at appropriate places along the fold lines 43 and 44 with the diameter of the hemicircular line lying along the fold lines. In the embodiment shown in FIG. 5, the inner wall panels 78, 78 have lock tabs 98 formed along their outer edge in a shape corresponding to that of the wheels 22. In the embodiment shown in FIGS. 1–4, each wheel 22 is formed by a double layer of the folding blank material formed by folding the wheel cut-out portion 100 of the floor panel along a fold line 102. In this embodiment, the lock tab 98 preferably has a rectangular shape. A forward lock tab 98 on each panel 76 also engages a slot 99 formed in the floor panel.

The rear panel group has an internal transverse fold line 104 that defines an outer wall panel 106 and an inner rear wall panel 108. Lock tabs 110 formed at the outer edge of the inner wall panel 108 is adapted to engage the transverse slots 112 formed in the fold line 40.

To form the folding blank 24 into a vehicle simulating display 12, each of the panel groups 30, 32, 34 and 36 is folded generally towards the floor panel 28. Each panel group is secured in the vehicle simulating position by inserting the various locking tabs described above in the corresponding slots formed in the floor panel and/or the hood support panels 80, 80. A suitable folding sequence is outlined in the following table.

TABLE II

Folding Sequence

I. Rear Panel Group
1. Fold panel 108 along line 104 towards panel 28 through 180°.
2. Fold panel 106 along line 40 towards panel 28 through 90°.

II. Side Panel Groups
1. Fold panel 78 along line 86 towards panel 28 through 180°.
2. Fold wheel portions 22 along line 102 towards panel 76 through 180°.
3. Fold rear flap 84 along line 96 toward panel 76 through 90°.
4. Fold panel 80 along line 90 towards panel 28 through 90° and along line 88 towards panel 28 through 90°.
5. Fold panel 76 over 42 toward panel 28 through 90° while simultaneously engaging flap 82 in the space between panel 106 and 108.
6. Engage tab 91 in slot 92 in panel 28.
7. Fold flap 82 along line 84 towards panel 28 through 90°.
8. Repeat steps 1–7 for the second side panel group.

III. Front Panel Group
1. Fold flaps 54 and 56 along lines 58 and 60 towards panel 20 and 50 through 90°.
2. Fold panel 46 along line 38 towards panel 28 through 90° to cover flaps 82.
3. Fold panel 48 along line 62 towards panel 28 through 90 to overlie panels 80.
4. In conjunction with step 3, fold panel 20 along line 64 away from panel 28 through an angle less than 90° and fold panel 50 along line 66 away from panel 28 through less than 90° so that panels 20 and 50 form an obtuse angle with respect to one another and flaps 54 and 56 are engaged in the opening 114.
5. Fold panel 52 along line 68 towards panel 28 through 180°.

IV. Locking Steps
1. Engage tabs 110 in slots 112, tabs 72 in slots 74, tabs 98 in the slot 99 and the wheel portion hole in panel 28 adjacent the inner surface of wheel simulating portion 100, and tabs 70*a* and 70*b* in slots 93.

2. Insert floor panel 116 in rear container area 14.

In the rear panel group 32, the panels 108 and 106 are folded in the same direction along the lines 104 and 112 to engage the locking tabs 110 in the slots 112 with the inner wall panel 108 and the outer rear wall panel 106 forming a right angle with the floor panel 28. The inner wall panel 108 is folded 180° to overlie the panel 106, and both panels are folded through 90° to an upright position with respect to the floor panel. The side panel groups 34 and 36 are similarly folded along the lines 44 and 86 until the inner and outer side wall panels 76 and 78 are generally at right angles to the floor panel.

When the outer side wall panels 76, 76 are folded through 90°, the wheel cut-out portions integral with the side panel, also fold through 90°. The wheel openings in the floor panel provide slots that receive the locking tabs 98 to secure the inner and outer wall panels of each side in a generally parallel, spaced apart relationship. Also, as shown in FIG. 3 the inwardly curving shape of the wheel opening adjacent the fold line 42 secures the wheel simulating portion 22 in its folded doubled-over position when the side panel 76 is upright with respect to the floor panel 28. The hood support panels 80, 80 are folded along the lines 88 and 90 so that the locking tabs 91, 91 are both engaged in the slot 92. The front grille flaps 82 are folded over along the lines 92 until they are essentially right angle to the outer side wall panels 76. The rear flaps 84, 84 are similarly folded along the lines 96, 96. When the rear flaps 84, 84 are folded, they each engage the space intermediate the inner and outer rear wall panels 106 and 108. This interlocked relationship secures the rear and side wall panels at generally right angles to one another and to the floor panel.

The front panel group 30 folds along the lines 38, 62, 64, 66 and 68 to place the front grill panel at substantially right angles to the floor panel, the hood panel 48 substantially parallel to the floor panel and overlying the hood support panels 80. The windshield panel 20 and outer front wall panel 50 extend generally upwardly. The inner front wall panel 52 is folded to overlie the outer panel 50 with the locking tabs 72 engaged in the slots 74. The panel 52 forms the front wall of the container area 14.

The front panel group is secured in this relationship by the "over-center" locking tabs 70*a* and 70*b* (FIGS. 1–4) or 70 (FIG. 5) which engage the hood support panels 80, 80 in a manner which prevents the windshield panel and outer front wall panels from moving in a forward direction. In the embodiment shown in FIGS. 1–4, the over-center locking tabs 70*a* and 70*b* engage the slots 93, 93 formed in the hood support panels. In the embodiment shown in FIG. 5, the tab 70 engages the rear edge of the hood support panels. It should be noted that the openings in the hood caused by folding the tabs 70 or 70*a* and 70*b* to engage the hood support panels 80 simulate vehicle hood vents. The windshield panel 20 and the outer front wall panel 50 preferably from an obtuse angle less than 180° such that the tendency of these panels to unfold to a coplanar relationship urges the tabs 70*a* and 70*b* into engagement with the slots 93. It is also significant that generally upright front end panels 20, 50 and 52 are therefore secured on opposite sides against a movement along the longitudinal axis of the vehicle by the over-the-center tabs 70*a* and 70*b* or 70 on one side of the panels and the tab or tabs 72 on the other side of the panels. This arrangement prevents an inadvertant unfolding of the display 12 and adds rigidity and structural strength to the panels 20, 50 and 52 as well as the entire vehicle 12.

The tuck flaps 54, 54 and 56, 56 each fold along the lines 58 and 60, respectively, to engage the openings 114 between the inner and outer side wall panel 76 and 78. The flaps 54 and 56, like the front grille flaps 82, improve the aesthetic appearance of the display, but they also interlock the front panel group to the side panel group and thereby secure and strengthen the folded structure.

When folded and assembled in the foregoing manner, the folding blank 24 forms a rigid, self-supporting vehicle simulating display in wich the rear container area 14 has a generally rectangular, open-top configuration. It should be noted that the double wall construction only serves to make the assembled vehicle stronger, but also has good thermal insulating properties, particularly when the folding blank material itself is a material with good insulting qualities such as corrugated cardboard. It should also be noted that when a relatively thick material is used for the folding blank, such as a corrugated cardboard, the fold lines 68, 86 and 104 are preferably double fold lines as shown in FIGS. 2 and 4 to facilitate the fold and the formation of the openings 114. Also, the cut lines may indicate lines where the blank sheet material is not cut through completely, but is readily sheared by a relatively small manual force. Such "cut" lines are particularly useful in the embodiment shown in FIG. 5 to detachably secure the blank 25 to the surrounding material 26. Alternatively, the cut lines along the periphery of the blank 25 can be cut completely through the material except for narrow, spaced apart connecting strips that are readily broken by hand to effect the detachment.

Although the lock tabs 74, 98 and 110 have been described as securing the wall panels with respect to the floor panel, it is also contemplated that this function can be performed by a flat, generally rectangular member 116, shown in phantom in FIG. 2, which may be formed from the same material as the folding blank 24. This member preferably conforms in shape to the floor panel and holds the inner wall panel 52, 76 and 108 in the vehicle simulating position. Also, the tab 70 can be formed on the hood support panel 80 and engage a slot in the hood panel and the flaps 84 can be secured to the rear panel 106 rather than the side panels 76.

There has been described a one piece folding blank that is easily folded and reliably locked in a configuration that simulates a vehicle. The folded structure is rugged, durable, self-supporting and has a double-walled, thermally insulating container area. While the invention has been described principally as a point of counter display for retail outlets in the form of a camping vehicle useful for both displaying and demonstrating the use of accessories for such camping vehicles, the invention can also be used to form other vehicles such as cars, buses, dump trucks or circus wagons having a variety of uses. For example, the vehicle can be used itself as a toy, or as a packaging or storage container for other toys such as building blocks. In another application, the thermally insulating container area can be used to carry or hold food either as a tray or a packaging device. For example, a simulated circus wagon can be used to hold food for catered children's parties. Further, the embodiment shown in FIG. 5 can be employed as a center fold in magazines as an advertising and promotional device to stimulate interest in the full size displays and the associated products.

Various modifications of the invention will become apparent to those skilled in the art from the foregoing description and the accompanying drawings. Such modifications are intended to fall within the scope of the appended claims.

What is claimed is:

1. A blank foldable to form a vehicle simulating display comprising, a generally rectangular floor panel, a front panel group foldably secured to a first edge of said floor panel, a pair of side panel groups each foldably secured to second and third edges of said floor panel, each side panel group including inner and outer side wall panels, a rear panel group foldably secured to a fourth edge of said floor panel opposite said first edge including inner and outer rear wall panels, said front, side and rear panels groups being foldable towards said floor panel to a vehicle simulating position in which said inner and outer rear wall panels are each generally perpendicular to said floor panel and together with said floor panel from a generally rectangular open-top container, and the inner wall panel and the outer wall panel of each side and rear panel group are in a mutually parallel relationship, and means formed in said blank for securing said front, side and rear panel groups in said vehicle simulating folded position including tab means in locking engagement with a portion of said front panel group and a portion of at least one of said side panel groups at a point spaced above said floor panel.

2. A folding blank vehicle simulating display according to claim 1 in which said front panel group includes an inner front wall panel that forms a front wall of said container when said front panel group is in the vehicle simulating position.

3. A folding blank, vehicle simulating display according to claim 2 in which said securing means further comprises means for holding said inner side wall, inner rear wall, and inner front wall panels in a generally perpendicular relation to said floor panel.

4. A folding blank vehicle simulating display according to claim 3 in which said holding means comprises tabs formed on each of said inner wall panels adapted to engage a corresponding slot formed in said floor panel.

5. A folding blank vehicle simulating display according to claim 3 in which said means for holding further comprises first flaps foldably secured to said front panel group and adapted to engage each of said side panel groups between said inner and outer side wall panels and second flaps foldably secured to one of each adjacent pair of side wall panels and rear wall panels and adapted to engage the other of said pair between its inner wall and its outer wall panels.

6. A folding blank vehicle simulating display according to claim 3 wherein said holding means comprises a generally flat member having a shape substantially comforming to that of the floor panel and adapted to be inserted in said container so that the edges of said flat member engages the inner surfaces of said inner wall panels when they are in the vehicle simulating position.

7. A folding blank vehicle simulating display according to claim 2 in which said front panel group in the vehicle simulating position includes a grille panel foldably secured to said first edge of said floor panel and aligned generally perpendicular to said floor panel, a hood panel foldably secured to said grille panel and aligned substantially parallel to said floor panel, a windshield panel foldably secured to said hood panel, and an outer front wall panel foldably secured between said windshield panel and said inner front wall panel.

8. A foldable blank vehicle simulating display according to claim 7 in which said side panel groups each include a hood support said hood panel panel foldable to support in a spaced relationship over said floor panel.

9. A foldable blank vehicle simulating display according to claim 7 in which said tab means is formed in said hood panel.

10. A folding blank vehicle simulating display according to claim 9 in which said windshield panel and said outer front wall panel form an angle less than 180 degrees to urge said tabs into said engagement with said hood support panels.

11. A folding blank vehicle simulating display according to claim 1 in which said floor panel has cut therein wheel simulating portions that are integral with said side panel group along said second and third edges of said floor panel, said wheel simulating portions being aligned generally perpendicular to said floor panel when the folding blank is in the vehicle simulating position.

12. A folding blank vehicle simulating display according to claim 1 in which the blank is a continuous piece of a flexible sheet material.

13. A folding blank vehicle simulating display according to claim 12 in which said blank is detachably secured along its periphery within a surrounding portion of said flexible sheet material.

14. A folding blank vehicle simlulating display according to claim 9 in which said outer wall panels are vehicle side simulating panels, said outer rear wall panel is a vehicle rear simulating panel, said grille panel is a vehicle grille simulating panel, said hood panel is a vehicle hood simulating panel, said tab means folds out of the plane of said vehicle hood simulating panel to form a vehicle hood vent simulating opening, and said windshield panel is a vehicle windshield simulating panel.

15. A folding blank vehicle simulating display according to claim 7 further comprising merchandise held for display in said open-top container.

16. A folding blank vehicle simulating display according to claim 15 wherein said merchandise is designed for use on vehicles of the type simulated.

17. A folding blank vehicle simulating display according to claim 7 further comprising a display board held in said open-top container and having an upper portion that extends above said container.

* * * * *